United States Patent [19]

Held

[11] 4,290,604

[45] Sep. 22, 1981

[54] RACQUETBALL RACQUET HAVING A METAL FRAME MESHABLE WITH A THROAT PIECE

[75] Inventor: Franklin R. Held, San Diego, Calif.

[73] Assignee: Ektelon, San Diego, Calif.

[21] Appl. No.: 64,367

[22] Filed: Aug. 7, 1979

[51] Int. Cl.[3] ..... A63B 49/02

[52] U.S. Cl. ..... 273/73 G

[58] Field of Search ..... 273/73 R, 73 C, 73 D, 273/73 G, 73 H, 78, 173

[56] References Cited

U.S. PATENT DOCUMENTS

| | | | |
|---|---|---|---|
| 713,953 | 11/1902 | Bussey | 273/73 G |
| 1,173,588 | 2/1916 | Larocque | 273/73 H |
| 1,452,803 | 4/1923 | Harris | 273/73 H |
| 3,211,455 | 10/1965 | Hyden | 273/78 |
| 3,642,283 | 2/1972 | Wilkens | 273/73 G |
| 3,664,669 | 5/1972 | Latham et al. | 273/73 G X |
| 3,908,995 | 9/1975 | Portz | 273/73 G |
| 3,912,268 | 10/1975 | Robinson | 273/73 H |

FOREIGN PATENT DOCUMENTS

| | | | |
|---|---|---|---|
| 2010450 | 9/1971 | Fed. Rep. of Germany | 273/73 D |

*Primary Examiner*—Richard J. Apley

*Attorney, Agent, or Firm*—Oldham, Oldham, Hudak & Weber Co.

[57] ABSTRACT

A racquetball racquet having a metal frame is disclosed, wherein increased stiffness in the metal frame is provided by a grooved contact between the inner surfaces of the frame comprising the outer perimeter of the racquet and a throat piece, completing the reinforced enclosure within which the strings are arranged. This grooved contact of the throat piece with the metal frame further resists the stress and strain of contact between the racquet and the racquetball, such that the entire surface of the strings behaves in a uniform and predictable fashion.

4 Claims, 6 Drawing Figures

RACQUETBALL RACQUET HAVING A METAL FRAME MESHABLE WITH A THROAT PIECE

BACKGROUND OF THE INVENTION

Heretofore, racquetball racquets have utilized metal frames which have inadequately compensated for the tremendous differential stress and strain generated in a bending and torsional manner when the racquetball racquet contacts the racquetball during use. While the art has previously determined that a metal frame is satisfactory for the structural components of a racquetball racquet, such as disclosed in U.S. Pat. No. 3,664,668, issued to the same inventor as that herein, on May 23, 1972, the art has failed to perceive the importance of constructing the frame and throat piece from meshable surfaces to increase resistance to differential bending and torsional stress and strain.

SUMMARY OF THE INVENTION

Therefore, an object of the invention is to provide a metal frame having extended portions to provide adequate mating surfaces for the throat piece to resist the bending and torsional stress and strain exerted on a frame during use.

It is another object of the invention to provide a throat piece which securely mates with the frame to prevent any shifting of the bending and torsional resistance inherent in the beveled surfaces of the frame as a result of differential stress and strain in the frame.

These and other objects of the invention, which will become more apparent as the detailed description of the preferred embodiment proceeds, are achieved by an improvement to the constructed reinforcement of a racquet having a metallic frame with a throat piece, said improvement comprising: a string reinforcement enclosure resistant to bending and torsional stress and strain, said string enclosure comprising a frame structure and a throat piece structure in mated contact, said frame structure having an inner surface, an outer surface, two side portions, and two extending flanges protruding outwardly from said inner surface at said side portions; the combination of said extending flanges and said inner surface forming an orthogonal recess; said throat piece structure having an inner surface, an outer surface, two side portions, and two notched recesses intruding inwardly from said throat piece outer surface at said throat piece side portions, the combination of said outer surface and said notched recesses at said side portions forming an orthogonal protrusion; said orthogonal protrusion of said throat piece meshable with said orthogonal recess of said frame, whereby the combination of said throat piece structure and said frame structure resists differential stress and strain caused by bending and torsional stress and strain.

DESCRIPTION OF THE DRAWINGS

For an understanding of the scope of two embodiments of the invention, reference is had to the following drawings, wherein.

DETAILED DESCRIPTION OF THE PREFERRED EMBODIMENTS

Figure 1:
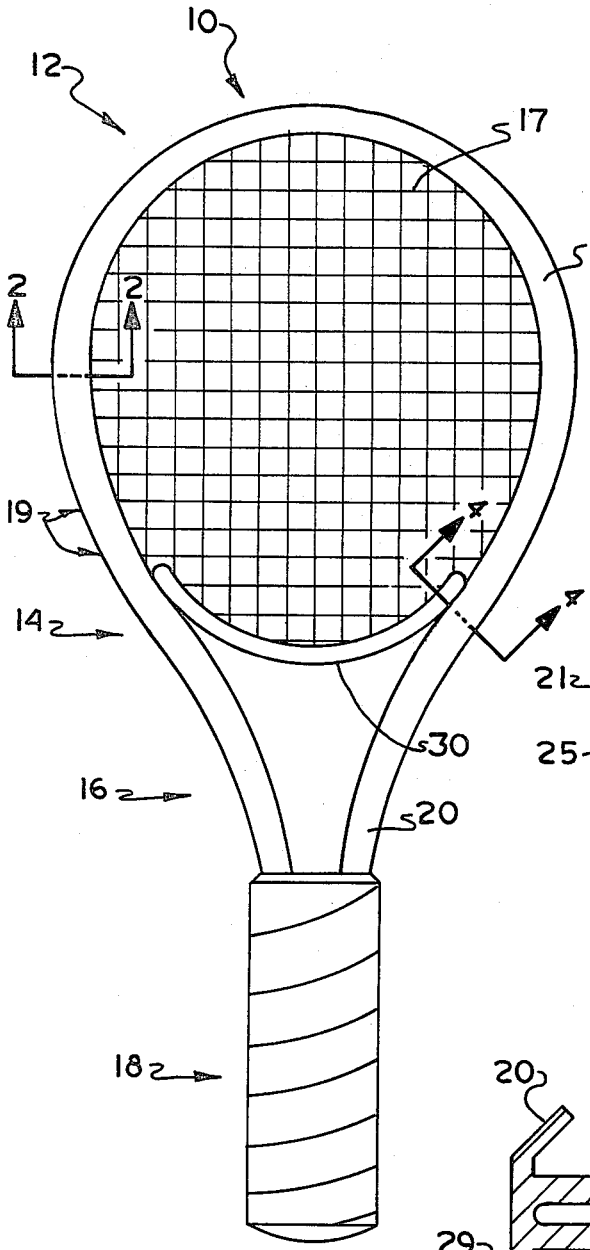
FIG. 1 is a side plan view of the racquetball racquet.
Figure 2:
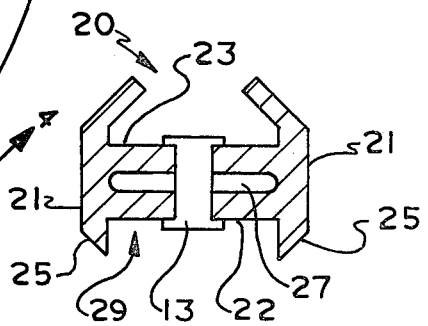
FIG. 2 is a cross sectional portion of the frame taken from lines 2—2 of FIG. 1.
Figure 4:
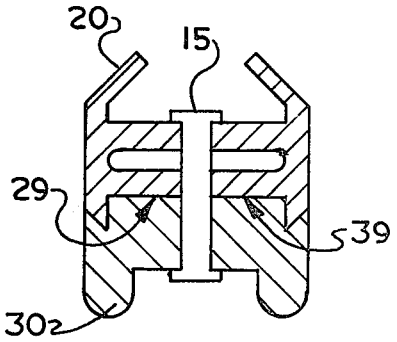
FIG. 4 is a cross sectional view taken on lines 4—4 of FIG. 1.

For an understanding of the scope of the improvements to the racquetball frame and throat piece, reference is had to FIG. 1. Racquetball racquet 10 may be identified by certain segments, such as racquetball head 12, throat 14, neck 16, and handle 18. The racquet 10 is composed of a frame 11 having two terminii which reside in the handle 18. Besides the restraint of handle 18, the frame 11 is contacted by throat piece 30 to form the reinforced enclosure 19 for strings 17 as strung through head eyelets 13 and throat rivets 15. The frame 11 may be in the form of beveled channel tubing 20 such as shown in FIGS. 2 and 4, or may exist in a beveled I-beam 40, such as that shown in FIGS. 5 and 6. The difference between these two embodiments is best illustrated by a comparison of FIGS. 2 and 5, wherein hollow portion 27 exists in beveled channel tubing 20, whereas that portion on beveled I-beam 40 is solid in depth.

The metal frame may be constructed out of a lightweight but sturdy metal, such as aluminum or magnesium, according to the requirements of tension known to those skilled in the art. The metal frame 11 may be extruded and bent in the form as generally shown in FIG. 1.

Referring now to FIG. 2, it may be seen that the beveled channel tubing 20 is composed of two side portions 21, an inner surface 22, an outer surface 23, and two extending flanges 25. The combination of the extending flanges 25 and inner surface 22 form orthogonal recess 29. The structure of this configuration of components of tubing 20, especially the formation of recess 29, is significant mating of tubing 20 with throat piece 30 such that there is increased resistance to bending and torsional stress and strain.

Figure 3:
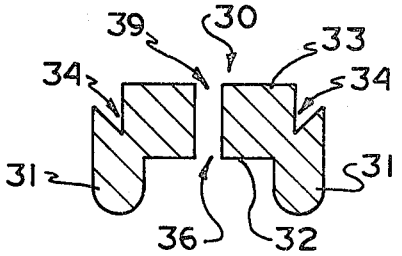
FIG. 3 is a cross sectional view of the throat piece.

To maintain continuity with respect to the resistance to bending and torsion throughout frame 11, throat piece 30 is altered to intimately engage frame 11, comprising either beveled channel tubing 20 or beveled I-beam 40. Referring to FIG. 3, throat piece 30 may be seen to comprise two side portions 31, an inner surface 32, an outer surface 33, two notched recesses 34, and a plurality of orifices 36 for rivets 15. The combination of outer surface 33 and notched recesses 34 form an orthogonal protrusion 39 which is capable of mating with orthogonal recess 29 of beveled channel tubing 20.

The throat pieces currently known to those skilled in the art provide an inadequate contiguous mating relationship between the throat piece 30 and the frame 11. Therefore, when a racquetball strikes strings 17, the frame 11, in an attempt to compensate for the bending and torsional stress and strain, reacts differently in its various portions. The bridging of the two sides of frame 11 by throat piece 30 bears full application of the differential stress and strain between each side of frame 11. Therefore, shifting of the throat piece 30 must be eliminated by providing a mating or meshing surface to intimately engage with the frame 11.

According to the present invention, the combination of outer surface 33, side portions 31, and recesses 34, are designed to accommodate the dimensions of the extended flanges 25, and inner surface 22 of beveled channel tubing 20. That is to say orthogonal protrusion 39 meshes with orthogonal recess 29. As seen in FIG. 4, the intimate engagement of throat piece 30 with tubing 20 prevents disengagement in any direction. The engagement of tubing 20 with throat piece 30 is restrained and maintained by throat rivets 15. The combination of the modification to the frame with the greater contact of that frame at recess 29 with protrusion 39 of throat piece 30 achieves a racquet having greater resistance to stress and strain for control of striking a racquetball over the entire surface of the strings 17.

Figure 5:
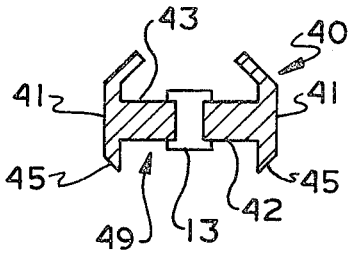
FIG. 5 is a cross sectional view of another embodiment of the racquetball frame.
Figure 6:
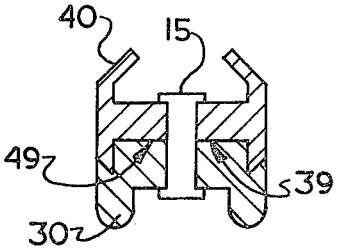
FIG. 6 is a cross sectional view of the mating contact of the embodiment described in FIG. 5 with the throat piece.

Referring to FIGS. 5 and 6, it may be seen that I-beam 40 is composed of two side portions 41, an inner surface 42, an outer surface 43, and two extending flanges 45. The combination of the extending flanges 45 and inner surface 42 form orthogonal recess 49. Recess 49 may mate or mesh with protrusion 39 according to the same principles as that discussed above with respect to beveled channel tubing 20. The only difference between I-beam 40 and tubing 20 is the presence of hollow portion 27. The mated engagement of I-beam 40 and throat piece 30 acts in the same manner to provide the increased resistance to stress and strain.

While in accordance with the Patent Statutes, two embodiments have been presented, it is to be understood that the invention is not to be limited thereto or thereby. Consequently, for an understanding of the scope of the invention, reference is had to the following claims.

What is claimed is:

1. A racquet having a metallic frame with a throat piece, wherein the improvement comprises:

the frame structure having a flat inner surface having a width, an outer surface, two side portions, and two extending flanges protruding outwardly from said inner surface at said side portions; each of said extending flanges having a height and having a flat surface connected to said flat inner surface and further having an outwardly beveled surface connected to said side portion; said inner surface width greater than said extending flange height;

the combination of said flat surfaces of said extending flanges and said flat inner surface forming an orthogonal recess, having greater width than depth;

the throat piece structure having an inner surface, a flat outer surface, having a width, two side portions, and two notched recesses intruding inwardly from said throat piece outer surface at said throat piece side portions, each of said notches recesses having a depth and having a flat surface connected to said flat outer surface and further having an outwardly beveled surface connected to said side portion; said outer surface width greater than said notched recess depth; the combination of said outer surface and said notched recesses at said side portions forming an orthogonal protrusion having a greater width than height;

said orthogonal protrusion of said throat piece in meshable, mated contact with said orthogonal recess of said frame, said meshable, mated contact occurring at said flat inner frame surfaces contiguous with said flat outer throat surfaces, and at said flat recess surfaces contiguous with said flat flange surfaces;

said beveled recess surfaces contiguous with said beveled flange surfaces; whereby the combination of said throat piece structure and said frame structure resists differential stress and strain caused by bending and torsional stress and strain.

2. A racquet according to claim 1, wherein said frame structure has a hollow portion between said inner surface and said outer surface.

3. A racquet according to claim 1, wherein said frame structure is composed of extrudable aluminum.

4. A racquet according to claim 1, wherein said throat piece structure is composed of extrudable aluminum.

* * * * *